US006169370B1

(12) United States Patent
Platzer

(10) Patent No.: US 6,169,370 B1
(45) Date of Patent: Jan. 2, 2001

(54) METHOD AND DEVICE FOR PRODUCING PLASMA WITH ELECTRODES HAVING OPENINGS TWICE THE DIAMETER OF THE ISOLATOR OPENING

(76) Inventor: Bernhard Platzer, Rosenberggürtel 46, Graz (AT), 8010

( * ) Notice: Under 35 U.S.C. 154(b), the term of this patent shall be extended for 0 days.

(21) Appl. No.: 09/389,349

(22) Filed: Sep. 3, 1999

Related U.S. Application Data

(63) Continuation of application No. PCT/AT98/00048, filed on Mar. 3, 1998.

(30) Foreign Application Priority Data

Mar. 4, 1997 (AT) ..... 368/97

(51) Int. Cl.[7] ..... H05H 1/30

(52) U.S. Cl. ..... 315/111.21; 315/111.31; 219/121.36; 313/231.31

(58) Field of Search ..... 315/111.21, 111.31; 313/231.31, 231.41; 219/121.36

(56) References Cited

U.S. PATENT DOCUMENTS 2,941,063 * 6/1960 Ducati et al. ..... 219/121.36
3,508,106 * 4/1970 Vecsernyes ..... 219/121.36
5,414,324 * 5/1995 Roth et al. ..... 315/111.21

* cited by examiner

*Primary Examiner*—Justin P. Bettendorf
(74) *Attorney, Agent, or Firm*—Jacobson, Price, Holman & Stern, PLLC

(57) ABSTRACT

A device for producing RF/HF induced low-energy plasma, in particular noble gas plasma, including a generator and a supply element for the plasma gas. The generator is coupled in a known manner to two, in particular, ring- or disk-shaped parallel, interspaced electrodes, each having at least one through-opening, and for at least one isolator to be positioned between the electrodes, the isolator having at least one particularly circular through-opening assigned to the through-opening of the electrode, whose through-opening is designed to confine the plasma formed by a plasma gas at a pressure of at least 0.01 bars, but preferably between 0.1 and 5 bars. The inside diameter of the through-opening of the electrodes is at least double, but especially approximately four to eight times that of the inside diameter of the through-opening of the isolator for confining the plasma.

40 Claims, 6 Drawing Sheets

METHOD AND DEVICE FOR PRODUCING PLASMA WITH ELECTRODES HAVING OPENINGS TWICE THE DIAMETER OF THE ISOLATOR OPENING

This is a continuation application of PCT/AT98/00048, filed Mar. 3, 1998.

BACKGROUND OF THE INVENTION

The present invention relates to a method for producing an RF/HF induced, low-energy plasma, in particular noble gas plasma, and a device for producing an RF/HF induced, low-energy plasma, in particular noble gas plasma, comprising a generator and a supply element for the plasma gas.

Methods and devices for producing a plasma, in particular noble gas plasma, are known in various embodiments, wherein such a plasma can be used for example as radiation source, in particular in emission spectrometry. By providing for a sample in the plasma, further possible applications of such a plasma are for example in the field of investigations relating to atomic emission, chemiluminescence, ion mobility, and as ion source for mass spectrometry. Without providing for a sample such a plasma can for example be used as a source for slow, thermalized electrons. In the field of ionization techniques for mass spectrometry such an electric discharge can be used instead of the commonly used corona discharge to ionize a component: of the gas, whereby this component in turn ionizes the sample molecule. In the context of a photoionization detector such a plasma can be used as a point-source for VUV radiation. In the context of ozone production a microplasma can be employed when in certain applications the total gas flow during ozone production has to be very low, for example when the ozone is to be introduced into the vacuum chamber of an analytical instrument. Furthermore such a plasma can for example generally be used for the production of redox-reagents to be introduced in small amounts into gaseous or liquid systems. Further possible applications of such a plasma comprise the use as VUV light source for the treatment of surfaces, in particular at atmospheric pressure.

For the production of plasmas various methods are known. Besides the possibility to form plasmas by means of an electric arc, preferably methods and devices are used, in which the energy necessary for plasma formation and maintenance is coupled to the gas by electromagnetic waves. Such a method and apparatus for the production of an HF-induced noble gas plasma can be found for example in DE-OS 36 38 880, wherein the energy should be coupled into the plasma capacitively. Relating to a microwave-induced noble gas plasma EP-A 0 184 912 can serve as an example, wherein in that known embodiment the microwave-induced plasma is subsequently to be employed for photoionization detection.

Problematic in such known methods and devices is on the one hand the coupling of the electromagnetic energy into the plasma gas, wherein in the known methods the employed power is in the range of approximately hundred watts. Therefore the power to be coupled is very high, wherein in addition to that of course adequate heat dissipation has to be provided in immediate vicinity of the produced plasma, to avoid damage to parts of the apparatus. For this purpose for example tubes made of an electrically non-conducting, high-temperature resistant material are used to separate the gas or plasma from the remaining parts of the apparatus, wherein it is immediately apparent that by providing such enclosing elements for the plasma, there is in addition increased need for adequate cooling devices, which renders the production of a plasma of low spatial spread, and preferably of a plasma which can be termed essentially and idealized as point-like, more difficult or even impossible. Such a device is known for example from U.S. Pat. No. 4,654,504.

In addition to that a plasma panel has been known from DE-A 26 46 785, wherein a discharge path is confined by layers of insulating material, and for the production of the plasma there are provided ring electrodes, which are supplied by direct current.

Furthermore devices are known, which use a plasma for either etching or coating of surfaces, for which EP-A 303 508 or JP-A 8274069 give examples. A plasma machining apparatus can for example be found in JP-A 8273894.

In addition to the possible applications for a low-power plasma, as discussed in detail above, plasma-arc torches can be found for example in DE-A 38 14 330 or DE-OS 25 25 939, which due to their high-energetic plasmas are not directly comparable with applications in the low-energy range.

SUMMARY OF THE INVENTION

Starting from the state of the art mentioned at the outset, the present invention aims at providing a method and device for the production of a low-energy plasma, by which, from a process-engineering point of view, a simple and stable way of producing a low-energy plasma is provided. With this it is in particular aimed at providing a plasma of low spatial spread with simultaneously simplified heat dissipation.

To solve these objects, the process of the subject invention for producing a RF/HF induced low-energy plasma, in particular noble gas plasma, is essentially wherein the energy is supplied through two parallel, interspaced, in particular ring- or disk-shaped electrodes, each having at least one through-opening, that said plasma is confined by at least one isolator, positioned between said electrodes, having at least one particularly circular through-opening assigned to the through-opening of said electrode, and that the pressure of the plasma gas is selected to be at least 0.01 bars, preferably between 0.1 and 5 bars. By confining said plasma, according to the present invention, with at least one isolator, which is positioned between parallel interspaced, in particular ring- or disk-shaped electrodes, the definition of the desired dimensions of the plasma, which can be selected according to the requirements, is successfully achieved. Furthermore it is possible to achieve through said isolator, in the particularly circular through-opening of which said plasma is produced and maintained, in a simple way and without the provision of additional confining elements, such as tubes in known embodiments, safe confinement of said plasma and simultaneously securing heat dissipation from the immediate vicinity of said plasma. By the particularly ring- or disk-shaped electrodes, which are positioned at both sides of said isolator and the through-openings of which are aligned with respect to each other, the supply of the energy necessary for the ignition and maintenance of said plasma is successfully achieved in a very small volume, so that overall a simple method for the production of such a low-power plasma, in particular noble gas plasma, can be provided at low power uptake and low gas consumption.

In accordance with a preferred embodiment it is proposed that said plasma is produced at atmospheric pressure, so that a further simplification in the implementation of the method for producing a low-energy plasma at low gas consumption can be achieved.

In accordance with a further preferred embodiment it is proposed to select the power of said plasma below 30 preferably below 10 W, so that with simple means a safe and sufficient heat dissipation can be achieved without the provision of costly cooling devices, wherein in the case of an array of plasma discharges said power can be achieved for each single discharge.

Within the scope of the method of the present invention it is furthermore proposed to preferably select the operating frequency higher than 5 kHz, preferably in the range of 50 kHz to 5 GHz, more preferably higher than 10 MHz, wherein the upper limit is essentially given by the requirement that the electromagnetic energy has to be produced by discrete components and transmitted along leads. Particularly preferable are for example the frequency ranges from 25 MHz to 45 MHz, as well as beyond 1000 MHz, in particular at approximately 2450 MHz, where simple and economic electronic components are available.

According to another preferred embodiment of the method of the present invention it is proposed, that the plasma gas is selected from helium or argon, wherein in particular helium is preferred as plasma gas due to its low atomic mass, as it causes almost no erosion at the electrodes. Moreover helium provides the best excitation conditions for halogens and other non-metals, whereas argon can be used mostly in technical applications.

In addition to the use of plasma gas for the formation of the plasma it may be provided for various applications that an additive gas is admixed to said plasma gas at an amount of at most 35 vol.-%, preferably less than 25 vol.-%, wherein said additive gas is selected from $CO_2$, air, hydrogen and oxygen, as being in accordance with another preferred embodiment. At this in particular hydrogen can be added, at reduced pressure, in a relatively high proportion, wherein hydrogen is particularly important for photoionization. As additive gas oxygen is used in particular for the production of ozone or in a photoionization detector for the production of oxygen atomic emission radiation, or as dopand gas in gas chromatography to prevent the deposition of soot during the fragmentation of organic compounds.

To solve the above mentioned objects, furthermore a device for producing a RF/HF induced low-energy plasma, in particular noble gas plasma, comprising a generator and a supply element for the plasma gas, is essentially wherein said generator is coupled to two in particular ring- or disk-shaped parallel, interspaced electrodes, each having at least one through-opening, that at least one isolator is positioned between said electrodes, said isolator having at least one particularly circular through-opening assigned to said through-openings of said electrodes, designed to confine said plasma formed by a plasma gas at a pressure of at least 0.01 bars, preferably between 0.1 and 5 bars, and that said inside diameter of said through-opening of said electrodes is at least double, especially approximately four to eight times that of said inside diameter of said through-opening of said isolator for confining said plasma. In that way an extremely compact embodiment of a device for producing a low-energy plasma, the dimensions of which can be easily selected according to the requirements, is successfully achieved, while it is at the same time possible to use matched elements of a simple geometry. By selecting the inside diameter of said through-opening of said electrodes to be at least double, but especially approximately four to eight times that of the inside diameter of said through-opening of said isolator confining the plasma it is possible to achieve by compact design and reliable supply of the energy necessary for the ignition and maintenance of said plasma, protection of the electrode material from said plasma, without the provision of additional confining elements for said plasma.

According to a preferred embodiment the construction is such that the electrodes each have an essentially concentric through-opening, in particular in the shape of a cylinder or a truncated cone, which, in the case of compact implementation allow the formation of a strictly defined, spatially stable discharge region.

To reduce sputtering effects at the electrodes, while providing sufficient internal electrode surface, and to limit current density while increasing the capacitance of the electrode glow, the through-openings of said electrodes are provided with rounded edges.

As already mentioned several times above, the present invention aims at the formation of a plasma of low spatial spread, and preferably of a plasma which can be termed idealized as point-like, with a strictly defined, spatially stable discharge region, wherein in this context it is preferably proposed that the internal diameter of the through-opening in the isolator confining the plasma is less than 1 mm, preferably at least 0.01 mm, and more preferably about 0.05 to 0.3 mm, wherein the thickness of the electrodes in this case is in the range of 0.1 to 1.5 mm.

In accordance with another preferred embodiment it is provided viewed with respect to the direction of gas flow, another isolator with a through-opening, which is essentially equivalent to said through-opening of said isolator positioned between said electrodes and confining said plasma, is positioned upstream of said first electrode. By positioning, viewed with respect to the direction of gas flow, another isolator with a correspondingly narrow through-opening upstream of the first electrode, a shielding action with respect to the approaching plasma gas is achieved, so that any impairment of the gas to be fed to the plasma, before the defined gap of actual plasma production between said electrodes, with potentially resulting unwanted side-effects, is avoided. Furthermore it is avoided that elements of the device according to the invention, positioned in such a way upstream of said electrodes and isolator, are subject to erosion or any other influence which could result in a change of the actual composition of the plasma gas. The isolator positioned upstream of said plasma could, if this side is at ground potential, be made of metal, for example Pt/Ir. To reduce the number of components it is proposed in another preferred embodiment that the first electrode, viewed with respect to the direction of gas flow, and the isolator positioned upstream of it are combined into one single component and that the through-opening corresponding to the through-opening confining the plasma is followed by a preferably conically expanding opening.

To protect operative equipment which is positioned downstream of the system of said two electrodes and said interposed isolator it is proposed, in particular when said system is followed by an optical analysis device, to position an additional isolator downstream of the second electrode, viewed with respect to the direction of gas flow, the through-opening of said isolator being slightly smaller than the through-opening of the adjacent electrode, which constitutes another preferred embodiment of the device according to the invention. By selecting the through-opening of this additional downstream isolator slightly smaller than the through-opening of the adjacent electrode, protection of the electrode surface is improved and the glow discharge on the electrode is spatially confined, which stabilizes the energy uptake of the entire plasma as well as the analytical zone inside the through-opening of the middle isolator. By selecting the geometry and dimensions of said downstream isolator it is possible to adapt to the requirements of subsequent devices, as it may be essential for example when using said plasma in conjunction with detectors respecting the solid angle of the emitted radiation as well as the field of view of downstream optics, wherein said downstream isolator should have a through-opening as large as possible, to take full advantage of the large solid angle of radiation emitted by the plasma.

For an accordingly simple embodiment and exact spatial confinement of the produced plasma it is proposed that the isolator confining the plasma be disk-shaped, and that its central region, showing said through-opening, is of diminished thickness compared to the peripheral regions. The greater thickness of the isolators peripheral region provides reliable protection against electrical arcing in the unit for producing a plasma, formed essentially by said electrodes and said interposed isolator, wherein the moderate thickness in the central region of the isolator enables, by selecting an appropriate geometry, the formation of an essentially point-like plasma of accordingly low power at atmospheric pressure. In this context it is furthermore preferably proposed that the decrease of thickness of the central region of said isolator in its cross-sectional view follows an arc-shaped, in particular circular arc-shaped, parabolic or cone-shaped contour, wherein through such arched bounds of the tapered or decreased, central region an eventual erosion of the isolator and electrodes can be reduced and simultaneously a defined geometry of the glow discharges upstream and downstream of said plasma can be obtained. The arched taper of the central region of the isolator improves in particular the flow profile of the gas and moreover such a structure of the isolator increases the exposure of said electrodes to the UV radiation of the plasma.

The geometry proposed according to the invention for said electrodes and isolators enables the use of the device according to the invention in various applications. For example in applications without analytical samples in the plasma, which do riot require a comparatively low dead volume, especially the upstream electrode can be essentially disk-shaped, wherein an arbitrary opening for the supply of plasma gas must be provided, which in a modified geometry of the isolators can also be positioned laterally or eventually formed by pores.

When using the device according to the invention as plasma reactor, for example for ion mobility spectrometry or ozone production, the narrow spatial confinement of the plasma discharge, which idealized can be regarded as point-like, enables a steep temperature gradient, which is particularly important at the exit from the plasma orifice or the downstream isolator, and hence the formation of thermodynamically stabile reaction products by quenching. On the other hand, when using the device to produce a microplasma according to the present invention for example for the production of ozone or hydrogen atoms, an exit-nozzle or downstream isolator, which can be a narrow isolator-nozzle or a metal orifice positioned downstream of the second isolator, can be employed, wherein, however, for the extraction of ions an electrical isolator is advantageous.

When using the device according to the invention in the field of mass spectrometry it is possible, by employing a small orifice of the last downstream isolator in combination with an accordingly high gas flow, to achieve a steep pressure gradient in the transition zone between plasma and vacuum, wherein in this case the orifice of the exit nozzle formed by the isolator is typically smaller than the through-opening of the isolator provided upstream of the electrodes. Overall the narrow spatial confinement of the plasma and the through-opening of the downstream isolator, provided by the present invention, enable at the same time the use of low gas flows, a high pressure in the plasma and precise spatial confinement. Such low gas flows consequently result in relatively low specifications on vacuum pumps, whereby, to further optimize the supply of energy in such an embodiment, the electrode closer to the vacuum region is preferably held at or near ground potential, whereas RF-power is supplied at the other electrode. To further increase the pressure inside the plasma the supply of an additive or auxiliary gas may be provided, for example in the region between the isolator positioned between the electrodes and the downstream isolator, which defines the exit-nozzle. For special applications it is also possible to introduce the sample to be analyzed or some reagent gas in such an essentially lateral region downstream of the actual plasma.

Moreover the arrangement of electrodes and isolators according the subject invention provides, that the electrodes, or preferably their cylindrical inner surface, are illuminated as directly as possible, which results in a stabilization of the discharge by the release of photoelectrons from the metal surface.

To be able to supply the energy required for ignition and maintenance of the plasma using compact electrodes, and to obtain sufficient robustness of said electrodes it is proposed in the present invention, that the material of the electrodes is selected from gold, platinum, tantalum, niobium, iridium, aluminum, platinum/iridium alloys, gold plated metal or base metals galvanically coated with noble metals. To obtain the required electrical isolation properties and sufficient thermal conductivity of the elements confining the plasma, while maintaining possibility of precise machining, it is further proposed that said isolator confining the plasma is formed by disks of aluminum-oxide ceramics, quartz, sapphire, ruby, diamond, or electrically poorly conducting or non-conducting oxide-, nitride- or carbide-ceramics, according to another preferred embodiment of the present invention.

To facilitate assembly of the device according to the invention, wherein the central section for producing plasma, consisting of electrodes and isolators, can for example be pre-assembled, it is further preferably proposed that said electrodes and isolators are either pressed together mechanically, for example by spring action, or are bonded together by known techniques of metal-ceramic bonding, in particular by soldering in vacuum or hydrogen atmosphere.

For a particularly simple mounting of the plasma production unit it is further preferably proposed that said electrodes and said isolator or isolators are held in fixtures and are mounted in a gas-tight manner. Due to the fact that in particular the spatial dimensions of the plasma are extremely small, it is further preferably proposed that the fixtures are equipped with centering mounts for said electrodes and/or isolators, in order to accomplish uniform supply of the energy required for ignition and maintenance of the plasma.

According to a further preferred embodiment it is provided that said fixtures have outlets or purging holes, in particular for supplying an additive gas, whereby besides the supply of additive gases it is in particular possible to exhaust reaction products, which may appear in the plasma producing unit for example when the plasma is used in the context of analysis- or detector equipment.

In order to achieve appropriate sealing between the single elements at high temperature it is further preferably proposed that said fixtures are coated, for example gold plated, at least in the section of the sealing surfaces facing said electrodes and/or isolators.

To accomplish an extremely compact unit while securing the appropriate coupling of electrical energy it is further preferably provided that said fixtures for said electrodes are provided with connectors for the supply of RF/HF energy.

As mentioned above, the isolator confining said plasma is, to obtain the desired properties of the essentially point-like, low-energy plasma, possibly made from materials which are difficult to produce and expensive, so that it is desirable to limit material usage to the immediate vicinity of plasma production and keep material expenditure to a minimum. For further heat dissipation and for isolation or support of the isolator having said through-opening it is further proposed that said isolator confining said plasma is enclosed by a further isolator which centers the isolator and shields said electrodes from each other, whereby said isolator can be made of correspondingly less costly material, as for example, according to temperature, boron nitride or polyimide.

As already mentioned above, such a plasma can be used for widely varying applications, wherein in this context it is preferably proposed that plasma production is followed by a device for analyzing sample materials introduced into said plasma.

BRIEF DESCRIPTION OF THE DRAWINGS

The invention is subsequently illustrated by means of embodiments shown in the attached schematic drawings, in which.

DETAILED DESCRIPTION OF PREFERRED EMBODIMENTS

Figure 1:
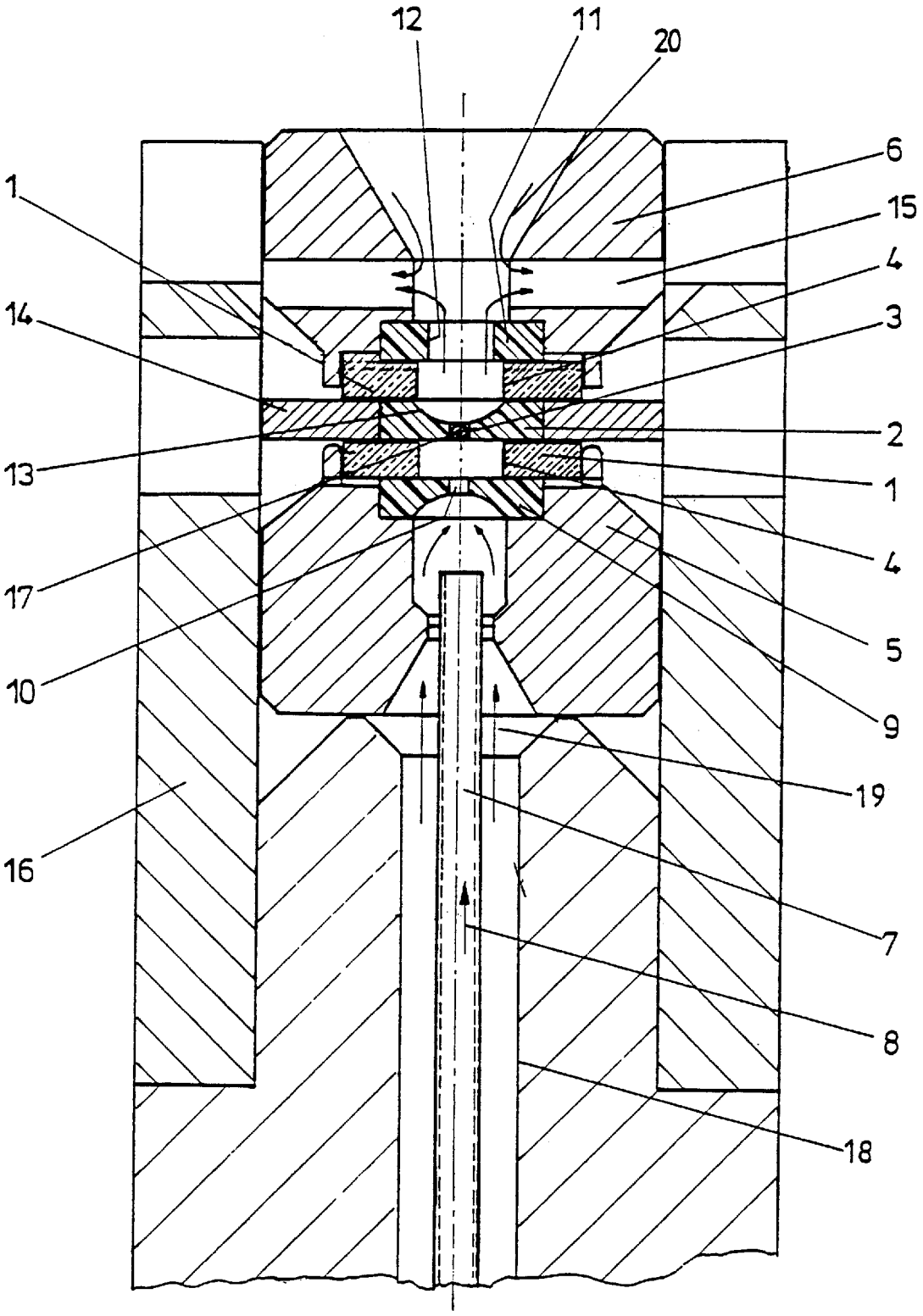
FIG. 1 shows a sectional view of a first embodiment of a device according to the invention, to produce a RF/HF-induced, low-energy plasma to implement the method according to the invention.

In FIG. 1 two parallel, interspaced, ring- or disk-shaped electrodes are designated as 1, and an isolator 2, made for example of ruby, sapphire or generically any poorly or non-conducting oxide ceramic, is positioned between said electrodes, wherein the isolator 2 has a through-opening 3, in which subsequently a plasma of small dimensions, which idealized can be regarded as point-like, is formed. Each electrode 1 has a through-opening 4, which significantly exceeds the dimensions of through-opening 3 of said isolator defining the dimensions of the plasma to be produced, schematically shown as 17, and which has about two to ten times the inside diameter of opening 3. The electrodes 1 are mounted in schematically indicated fixtures 5 or 6, through which, in a way not specifically shown, such as a spring-loaded contact pin, a connection is made with a generator for the supply of energy for ignition and maintenance of the plasma to be formed in the through-opening 3 of said isolator 2, wherein a sample supply is designated as 7. Said supply 7, which for example may be formed from a quartz capillary tube, is surrounded by a further tube-like duct 18, through which according to arrows 19 a plasma gas, such as for example helium or argon, and if need be an additive gas such as for example $CO_2$, air, hydrogen or oxygen, is supplied to the region of electrodes and isolators.

From FIG. 1 it can be seen, that viewed with respect to the direction of flow of sample and plasma gas, 8 respectively 19, another isolator 9 with a through-opening 10, which is essentially equivalent to said through-opening 3 of said isolator 2 confining said plasma 17, is positioned upstream of the first electrode. Said isolator 9, positioned upstream with respect to flow 8 serves essentially the purpose of avoiding arcing of the plasma into supply 7 and damaging the surrounding elements. It can be further seen that an additional isolator 11 is positioned downstream of the second electrode 1, viewed with respect to the direction 8 of plasma gas flow, the through-opening 12 of it being slightly smaller than the inner diameter of the adjacent electrode 1. This downstream isolator 11 optimizes or exactly delimits the radiation produced by plasma 17 in said orifice 3 according to the requirements. By selecting the through-opening 12 at least slightly smaller than the through-opening 4 of the adjacent electrode 1, protection of the electrode surface is improved and in particular the glow discharge on the electrode is spatially confined, which stabilizes the energy uptake of the entire plasma as well as the analytically interesting zone inside the through-opening of the middle isolator. To avoid sputtering effects the electrodes 1 can have rounded edges or must not have sharp edges. Further it is provided that, with respect to gas flow direction 8, the downstream surface of isolator 2 is formed by an arc-shaped generating curve 13, so that in the central region of isolator 2 a reduced thickness results, such that the essentially square dimensions of through-opening 3, in a sectional view, favor the production of a spherical and, in an idealized designation, point-like plasma 17.

The diameter of through-opening 3 in isolator 2, which defines the dimensions of the plasma to be formed, can be less than 0.5 mm and for example approximately 0.1 to 0.2 mm. The diameter of the through-openings 4 of electrodes 1, on the other hand, is for example 0.5 to 1 mm. The thickness of the electrodes 1 as well as of the isolators 2, 9, and 11 can be for example 0.5 mm, wherein because of the taper of the isolator 2 results in an accordingly reduced thickness of its central region.

It is therefore possible, with a simple construction, to provide a plasma source with very small and precisely definable spatial dimensions, such that at atmospheric pressure a low-power plasma with a power of for example below 20 W, and preferably between 5 and 10 W can be formed. Due to the low power it is furthermore possible to safely dissipate the resulting heat through the isolator 2, wherein, as can be seen from FIG. 1, the isolator 2 is surrounded by a further isolator 14, which on the one hand further dissipates the heat, and on the other hand safely shields the electrodes 1, which are positioned on both sides of isolator 2. Furthermore exhaust- or purge-openings 15 are indicated in fixture 6, through which exhaust occurs according to arrows 20.

Providing the fixtures 5 and 6 as well as said additional isolator 14 surrounding isolator 2 enables a secure positioning of the single elements having only small dimensions, wherein furthermore correspondingly gas-tight mounting for the single elements must be provided. The fixtures 5, 6 have centering mounts or provide directly for the centering of through-openings 3, 10, 12 of the single elements to be brought into line, wherein a surrounding, isolating housing is designated schematically by 16.

To achieve the corresponding tightness it may be provided that fixtures 5 or 6 are coated, for example gold plated, at least in the section of the sealing surfaces facing said electrodes 1 and/or isolators 2, 9, 11.

The joining of the electrodes 1 with the isolators 2, 9, or 11 can be effected either mechanically by providing appropriate springs, by which said electrodes 1 and isolators 2, 9 and 11 are pressed together, or alternatively known techniques of metal-ceramic bonding, for example soldering in vacuum or under hydrogen atmosphere, can be employed to achieve a correspondingly tight unit of said electrodes 1 and isolators 2, 9 and 11 in fixtures 5 and 6 or within each other.

Figure 2:
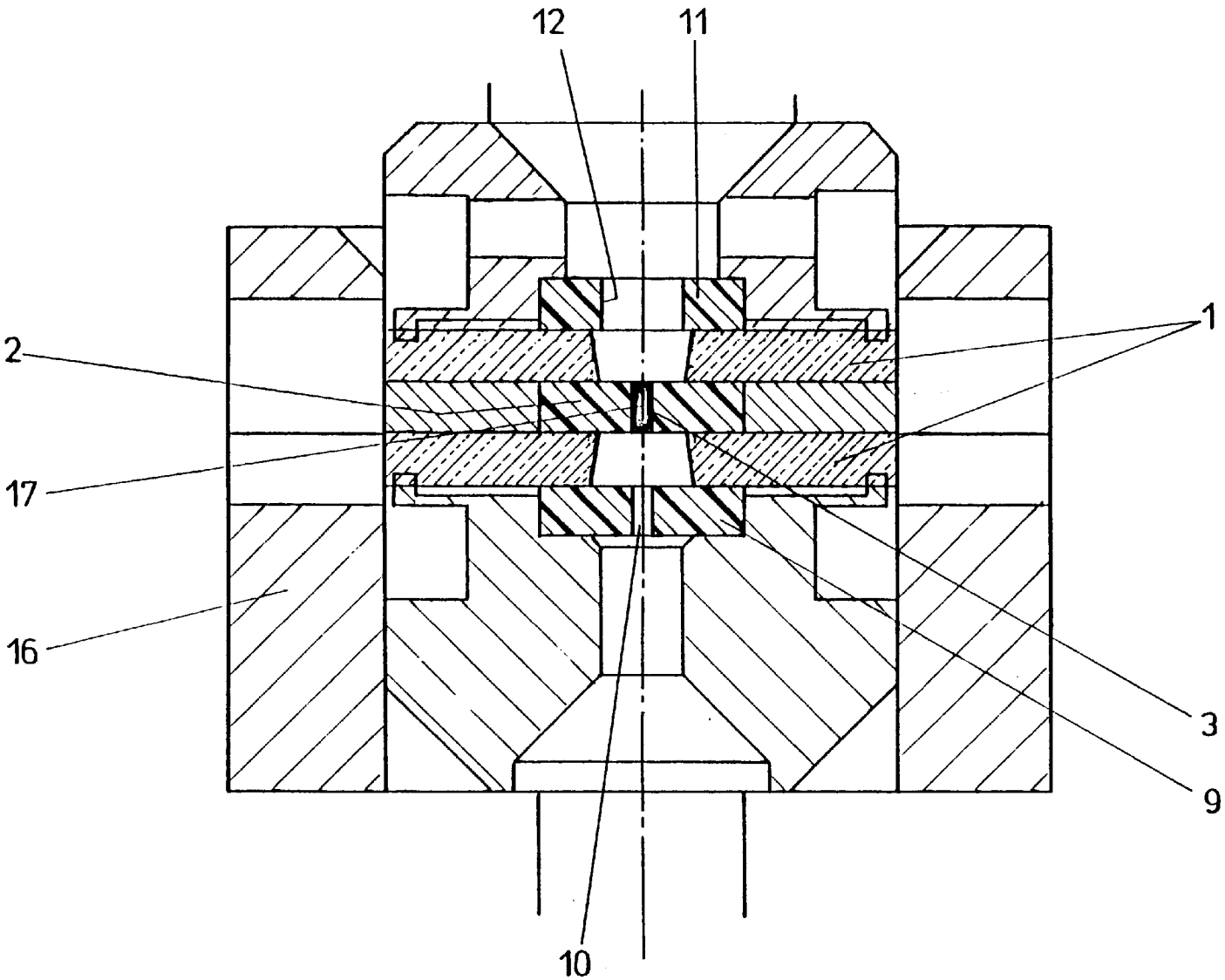
FIG. 2 shows in enlarged scale a partial illustration of a modified embodiment of a device according to the invention to implement the method according to the invention.
Figure 3:
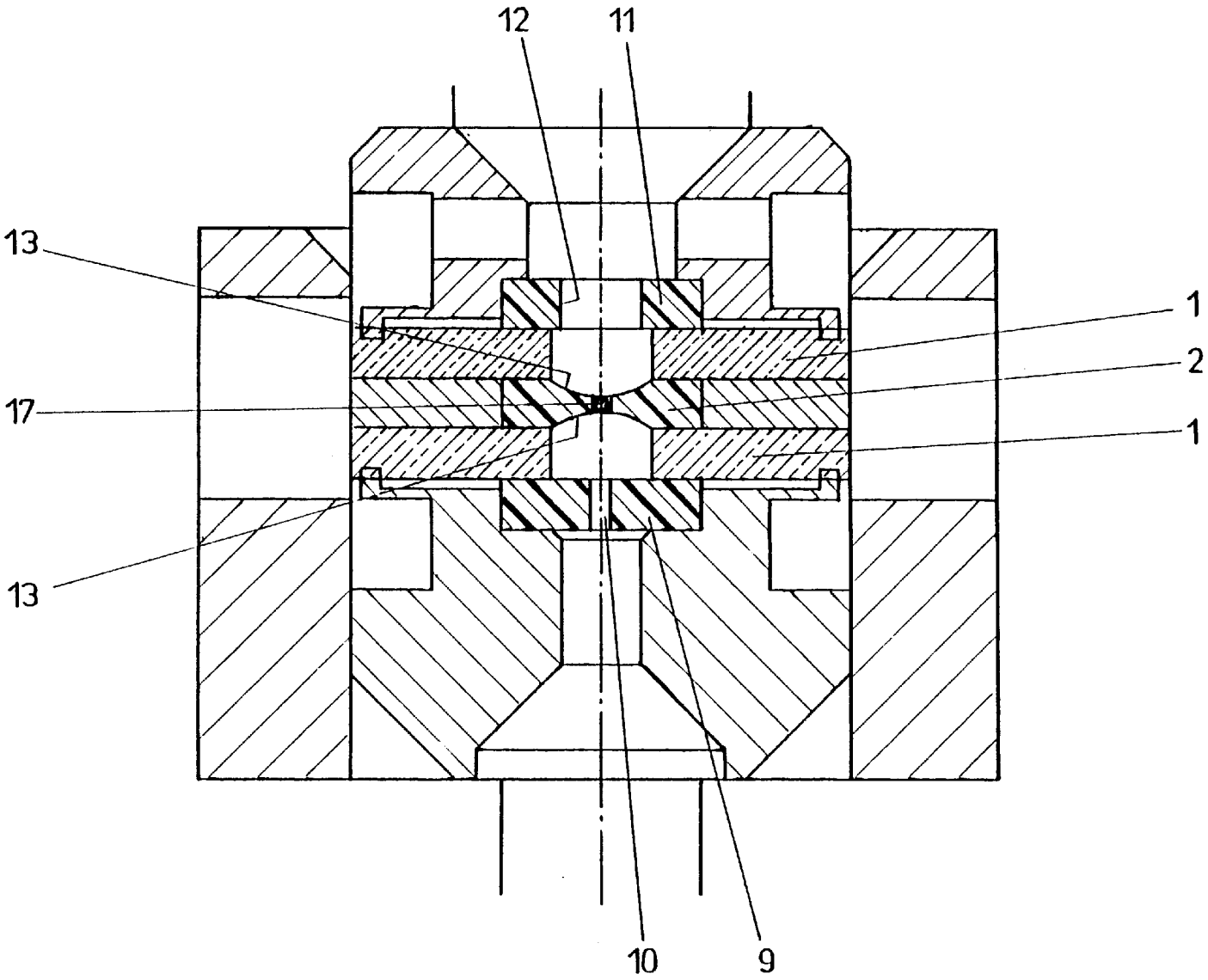
FIG. 3 shows in an illustration similar to FIG. 2 a further modified embodiment of a device according to the invention to implement the method according to the invention.

In the representations according to FIGS. 2 and 3, which in that case only show the sub-domain of the electrodes 1 as well as of the isolator 2 and, if this is the case, the isolators 9 and 11 which are positioned up- and downstream of it respectively, for same elements the reference numbers of the previous figure have been retained.

So the embodiment according to FIG. 2 provides that all of isolators 2, 9, and 11 are essentially disk-shaped having essentially constant thickness, whereas the embodiment according to FIG. 3 shows said isolator 2 confining plasma 17 tapered in its central region, in that a reduction of the thickness occurs on both sides along arc-shaped generating curves 13. Such a perfectly centered positioning of said plasma between said two electrodes 1 facing the isolator 2 is possible. To achieve maximum field strength in the plasma region, said electrodes 1 are inclined towards the isolator 2, i.e. formed as truncated cones.

Figure 4:
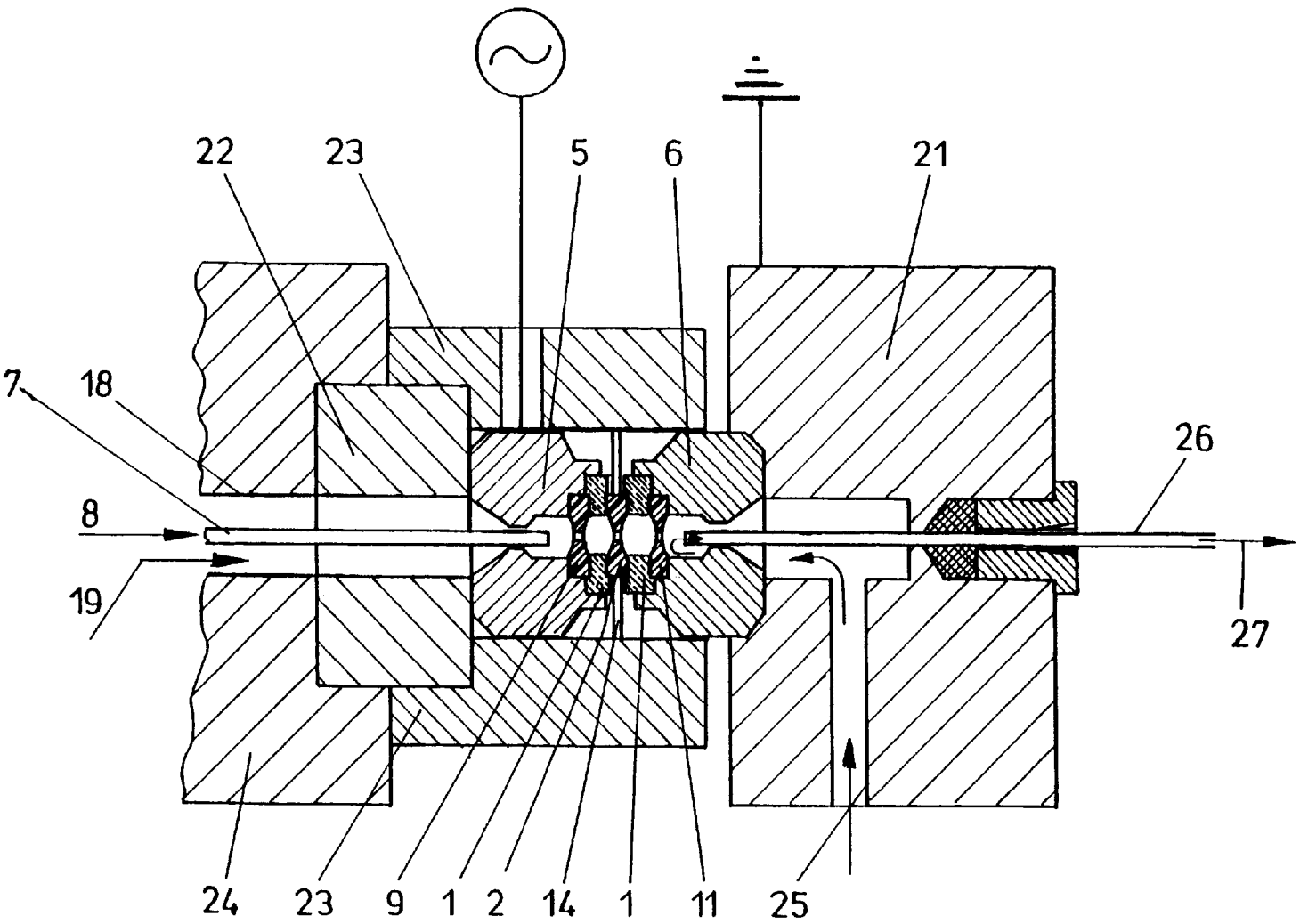
FIG. 4 is a sectional view of another modified embodiment of a device according to the invention to implement the method according to the invention using the device as plasma reactor.

In the varied embodiment, shown in FIG. 4, of a device used as plasma reactor, for plasma production again two electrodes 1 are provided, to which isolators 2, 9, and 11, all having very small orifice cross-sections, are positioned in between, up- and downstream respectively. The mounting of the unit formed of the electrodes 1 and the isolators 2, 9, and 11 is again in fixtures 5 and 6. Here the electrode 1, being coupled with the fixture 6 and another, if needed also cooled fixture 21, and positioned downstream with respect to flow directions 8 and 19, is kept essentially at ground potential, whereas RF energy is coupled to fixture 5, which houses the first electrode 1, with respect to flow direction. The fixtures 5 and 6 are at least partially covered by further isolators 22 and 23. When using the device shown in FIG. 4 as plasma reactor a sample is fed through a central inlet 7, whereas plasma gas and, if needed, additive gases are fed through the duct 18 surrounding said sample inlet tube 7, according to arrow 19. With this a fixture 24, positioned upstream and guiding sample and plasma gas, can be heated if need be.

Further it can be seen from FIG. 4 that through inlet openings 25 being provided in the fixture 21 a further additive gas can be introduced into the region of the electrodes 1 and isolators 2, 9, and 11 in a direction opposite to the feeding direction 8 or 19 of either sample or plasma gas respectively, wherein said additive gas serves for example cooling purposes, increases the pressure in the region of plasma production and simultaneously serves as transport gas. The reaction products, which subsequently are used for example for mass spectrometry or chemiluminescence, are transported according to arrow 27 through outlet 26, which again may be in the form of a quartz capillary tube, if need be into a vacuum region, for further analysis.

For pertinent applications, in particular as ion source, an altered, with respect to the representation in FIG. 4, configuration of the power supply at the electrode, for example by exchanging connections for ground potential and supply of RF energy, may be selected.

Figure 5:
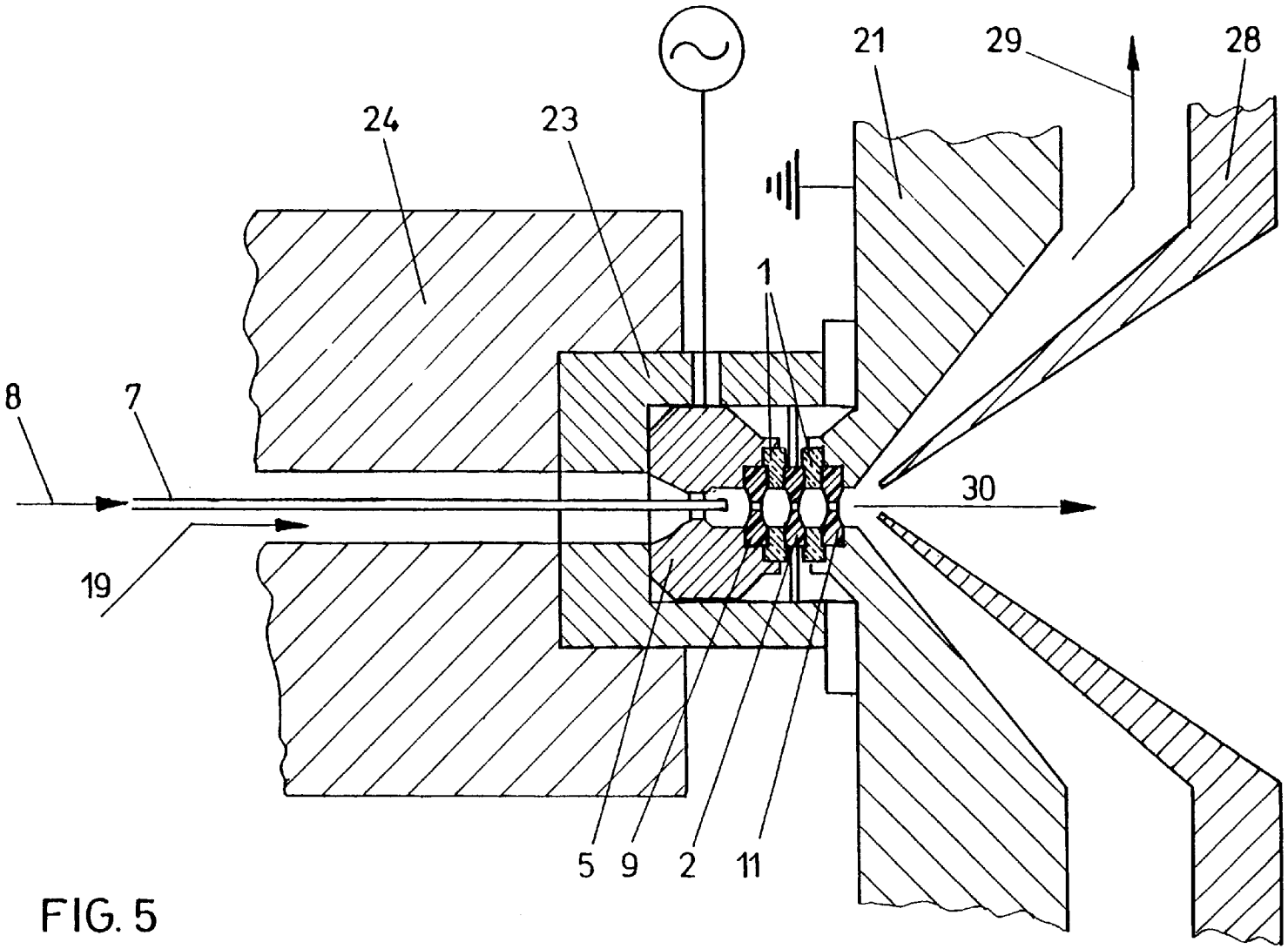
FIG. 5 is a sectional view of another modified embodiment of a device according to the invention to implement the method according to the invention using the device in connection with a mass spectrometer.

In the embodiment according to FIG. 5, which is particularly useful with a mass spectrometer, for the same components again the reference numbers of previous figures have been retained. Likewise in this embodiment in particular the isolators 2, 9, and 11 haze very small through-openings, wherein again the second electrode 1, viewed with respect to the direction of flow 8 or 19, is connected to ground potential through the fixture or support 21, whereas the first electrode 1 is fed with RF/HF energy across fixture 5. The region of plasma production, as it is defined by the electrodes 1 and isolators 2, 9 and 11, is followed by a schematically shown shielding device 28, wherein upstream of said shielding device for use in a mass spectrometer, according to arrow 29, a primary vacuum is formed, whereby subsequently in the outlet region of reaction products, according to arrow 30, a higher vacuum has to be provided.

If needed, supply of an additive gas can be provided also into the region immediately upstream of the last isolator 11, viewed in the direction of flow. Further the upstream fixture 24 may again be provided with a heating appliance not shown in detail.

Figure 6:
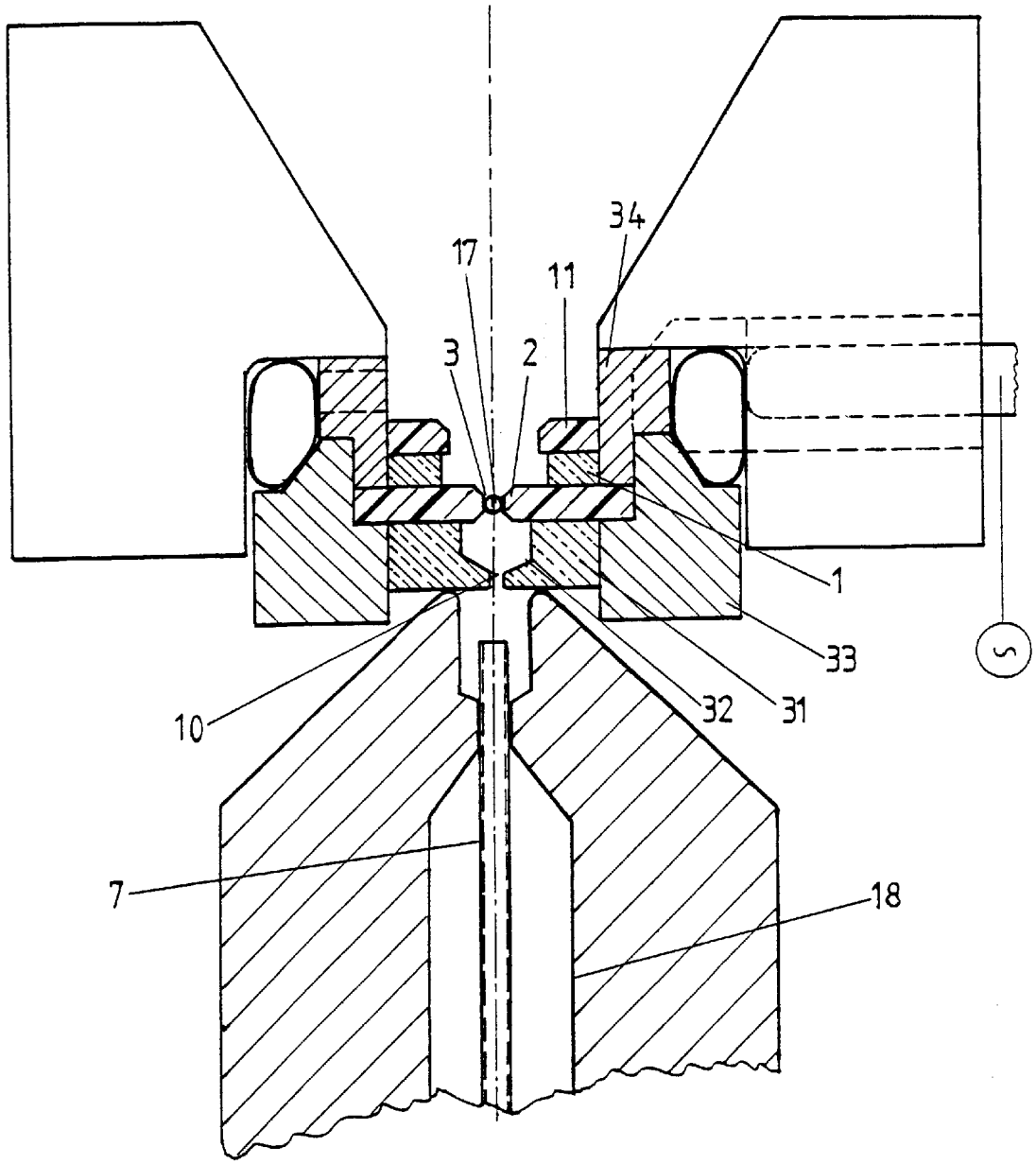
FIG. 6 is a sectional view of another modified embodiment of a device according to the invention to implement the method according to the invention.

In the modified embodiment shown in FIG. 6 the reference numbers of the previous figures for same components have again been retained. So the isolator 2 again has a through-opening 3 which in turn confines plasma 17. The inlet for a sample is designated as 7. The isolator 2 for the confinement of said plasma 17 is again positioned between two ring- or disk-shaped electrodes, wherein the downstream electrode 1 again is formed similarly to the previous embodiments. In contrast to previous embodiments the upstream electrode is combined with the isolator positioned upstream of the first electrode, the resulting unit bein designated as 31. The unit 31 has similarly to previous embodiments again an inlet- or through-opening 10, which corresponds essentially to the through-opening 3 of the isolator 2 for confinement of plasma 17. Starting from the through-opening 10 of the unit 31 said unit is provided with a conically expanding or essentially pot-shaped cavity 32, such that overall, for the lines of electric flux to be formed between the electrodes to confine the plasma, a configuration essentially corresponding to the previous embodiments results. Herewith the conically expanding or pot-like cavity may be shaped, according to geometric requirements, having a depth corresponding to about twice its diameter.

The unit formed by the electrodes and isolators is again held in fixtures, which in the embodiment shown in FIG. 6 are designatd as 33 and 34. From FIG. 6 it can be further seen that unlike the previous embodiments the isolator 2 for the confinement of plasma 17 extends to the fixtures 33 or 34 so wherefrom overall in the embodiment shown in FIG. 6 a reduced number of components results, which have to conform to each other or be connected to each other.

To increase the total power it can furthermore be provided that both said electrodes and the isolator 2 for the confinement of the plasma are each provided with an array of corresponding through-openings, wherein said through-openings are arranged in such a way that a focussing of the power emitted from single plasma sources to a common center or focus is feasible.

What is claimed is:

1. Method for producing an RF/HF induced low-energy plasma, wherein the energy is supplied through two ring- or disk-shaped parallel, interspaced electrodes, each having at least one through-opening, wherein the plasma is confined by at least one isolator, positioned between said electrodes, having at least one substantially circular through-opening assigned to the through-opening of the electrodes, and wherein the pressure of the plasma gas is at least 0.01 bars, and an inside diameter of said through opening of said electrodes being at least double that of an inside diameter of said through opening of said isolator.

2. Method as claimed in claim 1, wherein the plasma is produced at atmospheric pressure.

3. Method as claimed in claim 1, wherein the power of the plasma is selected to be below 30 W.

4. Device as claimed in claim 3, wherein the power of the plasma is selected to be below 10 W.

5. Method as claimed 1, wherein the plasma gas is selected from the group consisting of helium and argon.

6. Method as claimed in claim 1, wherein an additive gas is admixed to said plasma gas at an amount of at most 35 vol.-%, wherein said additive gas is selected from the group consisting of $CO_2$, air, hydrogen and oxygen.

7. Device as claimed in claim 6, wherein the additive gas is admixed to said plasma gas at an amount of less than 25 vol.-%.

8. Method as claimed in claim 1, wherein the frequency is selected to be at least 5 kHz.

9. Device as claimed in claim 8, wherein the frequency is selected to be in the range of 50 KHz to 5 GHz.

10. Device as claimed in claim 9, wherein the frequency is selected to be above 10 MHz.

11. Device as claimed in claim 1, wherein the pressure of the plasma gas is between 0.1 and 5 bars.

12. Device for producing an RF/HF induced low-energy plasma, comprising an RF/HF generator and a supply element for the plasma gas, wherein said generator is coupled to two ring- or disk-shaped parallel, interspaced electrodes, each having at least one through-opening, wherein at least one isolator is positioned between said electrodes, said isolator having at least one substantially circular through-opening assigned to said through-openings of said electrodes, designed to confine said plasma formed by a plasma gas at a pressure of at least 0.01 bars, and wherein said inside diameter of said through-opening of said electrodes is at least double that of said inside diameter of said through-opening of said isolator for confining said plasma.

13. Device as claimed in claim 12, wherein an additional isolator is positioned downstream of the second electrode, viewed with respect to the direction of gas flow, the through-opening of said isolator being slightly smaller than said through-opening of the adjacent electrode.

14. Device as claimed in claim 12, wherein said isolator confining said plasma is disk-shaped and that its central region, showing said through-opening is of diminished thickness compared to the peripheral regions.

15. Device as claimed in claim 14, wherein the decrease of thickness of the central region of said isolator in its cross-sectional view follows an arc-shaped contour.

16. Device as claimed in claim 15, wherein said arc-shaped contour is selected from the group consisting of circular arc-shaped contour, parabolic shaped contour and cone-shaped contour.

17. Device as claimed in claim 12, wherein the material of the electrodes is selected from the group consisting of gold, platinum, tantalum, niobium, iridium, aluminum, platinum/iridium alloys, gold plated metal and base metals galvanically coated with noble metals.

18. Device as claimed in claim 12, wherein said isolator confining the plasma is formed by disks selected from the group consisting of aluminum-oxide ceramics, quartz, sapphire, ruby, diamond, and one of electrically poorly conducting and non-conducting oxide-, nitride- or carbide-ceramics.

19. Device as claimed in claim 12, wherein said electrodes and said isolator or isolators are held in fixtures and are mounted in a gas-tight manner.

20. Device as claimed in claim 19, wherein the fixtures are equipped with centering mounts for at least one of said electrodes and said isolators.

21. Device as claimed claim 19, wherein said fixtures have outlets or purging holes, for supplying an additive gas.

22. Device as claimed in claim 19, wherein said fixtures are coated at least in the section of the sealing surfaces facing at least one of said electrodes and said isolators.

23. Device as claimed in claim 22, wherein said fixtures are coated by gold plate.

24. Device as claimed in claim 19, wherein said fixtures for said electrodes are provided with connectors for the supply of RF/HF energy.

25. Device as claimed in claim 12, wherein plasma production is followed by a device for analyzing sample materials introduced into said plasma.

26. Device as claimed in claim 12, wherein said isolator confining said plasma is enclosed by a further isolator which centers the isolator and shields electrodes from each other.

27. Device as claimed in claim 12, wherein the electrodes each have an essentially concentric through-opening.

28. Device as claimed in claim 27, wherein said through-opening is in a shape of a truncated cone.

29. Device as claimed in claim 27, wherein said through-opening is in a shape of a cylinder.

30. Device as claimed in claim 12, wherein said through-openings of said electrodes are provided with rounded edges.

31. Device as claimed in claim 12, wherein the pressure of the plasma gas is between 0.1 and 5 bars.

32. Device as claimed in claim 12, wherein said inside diameter of said through-opening of said electrodes is approximately four to eight times that of said diameter of said through-opening of said isolator.

33. Device as claimed in claim 12, wherein, viewed with respect to the direction of gas flow, another isolator with a through-opening is positioned upstream of said fist electrode.

34. Device as claimed in claim 12, wherein the internal diameter of said through-opening in sad isolator confining said plasma is less than 1 mm.

35. Device as claimed in claim 34, wherein the internal diameter of said through-opening in said isolator is at least 0.01 mm.

36. Device as claimed in claim 35, wherein the internal diameter of said through-opening in said isolator is about 0.05 to 0.3 mm.

37. Device as claimed in claim 12, wherein said electrodes and isolators are one of pressed together mechanically and bonded together by metal-ceramic bonding.

38. Device as claimed in claim 37, wherein the mechanical pressing is by spring action.

39. Device as claimed in claim 37, wherein the metal-ceramic bonding is soldering in one of a vacuum and hydrogen atmosphere.

40. Device as claimed in claim 12, wherein the first electrode, viewed with respect to the direction of gas flow, and the isolator positioned upstream of it are combined into one single component and wherein the through-opening corresponding to said through-opening in the isolator confining said plasma is followed by a conically expanding opening.

* * * * *